US009482995B2

(12) United States Patent
Hayakawa

(10) Patent No.: US 9,482,995 B2
(45) Date of Patent: Nov. 1, 2016

(54) IMAGE FORMING APPARATUS THAT CHANGES A DEVELOPING BIAS OR SURFACE POTENTIAL

(71) Applicant: Masahiko Hayakawa, Aichi-ken (JP)

(72) Inventor: Masahiko Hayakawa, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/011,010

(22) Filed: Aug. 27, 2013

(65) Prior Publication Data

US 2014/0056604 A1 Feb. 27, 2014

(30) Foreign Application Priority Data

Aug. 27, 2012 (JP) ..... 2012-186935

(51) Int. Cl.
*G03G 15/16* (2006.01)
*G03G 15/06* (2006.01)
*G03G 15/00* (2006.01)

(52) U.S. Cl.
CPC ..... *G03G 15/1675* (2013.01); *G03G 15/065* (2013.01); *G03G 15/50* (2013.01)

(58) Field of Classification Search
CPC ..... G03G 15/1675
USPC ..... 399/44
See application file for complete search history.

(56) References Cited

U.S. PATENT DOCUMENTS 5,084,737 A * 1/1992 Hagen et al. ..... 399/44
5,532,794 A * 7/1996 Tokuyama ..... G03G 15/047 399/44
2004/0091277 A1* 5/2004 Miyamoto et al. ..... 399/50
2008/0187348 A1* 8/2008 Kwon ..... 399/89
2010/0247123 A1* 9/2010 Honjoh ..... G03G 15/757 399/44
2011/0008065 A1* 1/2011 Yanagihara ..... 399/66
2011/0318070 A1* 12/2011 Whitney et al. ..... 399/313

FOREIGN PATENT DOCUMENTS

JP 2004170968 A 6/2004
JP 2009-181073 * 8/2009 ..... G03G 15/02
JP 2010256836 A 11/2010

* cited by examiner

*Primary Examiner* — Walter L Lindsay, Jr.
*Assistant Examiner* — Philip Marcus T Fadul
(74) *Attorney, Agent, or Firm* — Scully, Scott, Murphy & Presser, P.C.

(57) ABSTRACT

An image forming apparatus includes an image carrying member, a developer carrying member configured to carry developer to be supplied to the image carrying member, a transfer member configured to transfer a developer image formed on the image carrying member to a sheet passing between the image carrying member and the transfer member, a detector configured to detect a temperature, and a control device. The control device is configured to change, in response to a sheet interval, a developing bias to be applied to the developer carrying member from a first developing bias to a second developing bias at a changing rate based on a temperature detected by the detector, the changing rate being an amount of change in the developing bias per unit time based on the temperature.

17 Claims, 9 Drawing Sheets

TRANSFER BIAS
CHARGING BIAS
SURFACE POTENTIAL OF PHOTOSENSITIVE DRUM
DEVELOPING BIAS
-It1
-It2
0
Ve
Vd2
Vd1
TIME
TA
TB
TC
TD
T1
T2
t1
t2
t3
t4
t5
t6
t7
t8
t9
t10
t11
t12
1st PAGE
PAGE INTERVAL
2nd PAGE

Fig.5

| | Th≦10℃ | 10℃<Th≦15℃ | 15℃<Th≦20℃ | 20℃<Th |
|---|---|---|---|---|
| H≦25% | 25ms | 20ms | 10ms | 5ms |
| 25%<H≦35% | 20ms | 15ms | 10ms | 5ms |
| 35%<H≦45% | 20ms | 15ms | 10ms | 5ms |
| 45%<H≦55% | 15ms | 10ms | 5ms | 5ms |
| 55%<H | 10ms | 10ms | 5ms | 5ms |

IMAGE FORMING APPARATUS THAT CHANGES A DEVELOPING BIAS OR SURFACE POTENTIAL

CROSS REFERENCE TO RELATED APPLICATION

This application claims priority from Japanese Patent Application No. 2012-186935, filed on Aug. 27, 2012, which is incorporated herein by reference in its entirety.

FIELD

Aspects of the disclosure relate to an image forming apparatus including a transfer member configured to transfer a developer image formed on an image carrying member to a sheet.

BACKGROUND

A known image forming apparatus is configured to, during continuous printing, reduce electrostatic discharge from occurring between a trailing end portion of a sheet and a photosensitive drum and reduce inconsistency in density due to a change in the surface potential of the photosensitive drum. Specifically, in the image forming apparatus, a transfer bias is turned off before the trailing end portion of the sheet passes a transfer position between the photosensitive drum and a transfer roller, thereby the electrostatic discharge is reduced from occurring between the trailing end portion of the sheet and the photosensitive drum when the trailing end portion of the sheet passes the transfer position.

When the transfer bias is turned off in such a case, there is a problem that the absolute value of a surface potential in a portion (affected by the turning off of the transfer bias) of the photosensitive drum may get higher than that in other portions of the photosensitive drum, resulting in inconsistency in density. Specifically, even when the portion whose absolute value has become great is exposed, the portion should have greater surface potential than the other portions. Developer does not remain on the portion and thus inconsistency in density occurs.

In the known image forming apparatus, when an area of the photosensitive drum corresponding to a period of time during which the transfer bias is off (or an area of the photosensitive drum passing the transfer position while the transfer bias is off) reaches the developing roller, the developing bias is made slightly greater than the normal developing bias. Through the application of the greater developing bias, toner can be supplied to the portion of the photosensitive drum where the surface potential has become great (or the exposed portion thereof). Thus, toner can remain on the portion where the surface potential has become great and inconsistency in density can be reduced.

SUMMARY

However, in the known image forming apparatus, there is a possibility that inconsistency in density may occur when the temperature and the humidity change.

This is because, due to the change in the temperature and humidity, a rise time and a fall time until a target transfer bias is achieved fluctuate. More specifically, a period of time from when the transfer bias is changed from the normal transfer bias to the off state till when the transfer bias is returned from the off state to the normal transfer bias (hereinafter referred to as "a time for changing the transfer bias") is set to be longer as the temperature and the humidity are lower.

A period of time from when the developing bias is changed from the normal developing bias to a slightly greater developing bias till when the developing bias is returned from the slightly greater developing bias to the normal developing bias (hereinafter referred to as "a time for changing the developing bias") is set to be longer as the temperature and the lower humidity are lower as in the case with the time for changing the transfer bias. However, as the amount of change in the developing bias is extremely smaller than that in the transfer bias, the time for changing the developing bias is little affected by the temperature and the humidity. Thus, the change in the temperature and humidity may cause a big difference between the time for changing the transfer bias, which is more affected by the temperature and the humidity, and the time for changing the developing bias, which is less affected by the temperature and the humidity. In this case, toner cannot remain on the portion of the photosensitive drum where the surface potential has become great, causing a problem of inconsistency in density.

Illustrative aspects of the disclosure provide an image forming apparatus configured to reduce a possibility of occurring inconsistency in density caused by control of the transfer bias to be applied to reduce electrostatic discharge between the trailing end portion of the sheet and the photosensitive drum.

According to an aspect of the disclosure, an image forming apparatus includes an image carrying member, a developer carrying member configured to carry developer to be supplied to the image carrying member, a transfer member configured to transfer a developer image formed on the image carrying member to a sheet passing between the image carrying member and the transfer member, a detector configured to detect a temperature, and a control device. The control device is configured to: change a transfer bias to be applied to the transfer member from a first transfer bias to a second transfer bias in response to a sheet interval between the sheet and a next sheet; and change, in response to the sheet interval, a developing bias to be applied to the developer carrying member from a first developing bias to a second developing bias at a first changing rate when the detector detects a first temperature and at a second changing rate when the detector detects a second temperature, the first changing rate being an amount of change in the developing bias per unit time when the detector detects the first temperature, the second changing rate being an amount of change in the developing bias per unit time when the detector detects the second temperature.

According to an aspect of the disclosure, an image forming apparatus includes an image carrying member, a developer carrying member configured to carry developer to be supplied to the image carrying member, a transfer member configured to transfer a developer image formed on the image carrying member to a sheet passing between the image carrying member and the transfer member, a detector configured to detect a humidity, and a control device. The control device is configured to: change a transfer bias to be applied to the transfer member from a first transfer bias to a second transfer bias in response to a sheet interval between the sheet and a next sheet; and change, in response to the sheet interval, a developing bias to be applied to the developer carrying member from a first developing bias to a second developing bias at a first changing rate when the detector detects a first humidity and at a second changing rate when the detector detects a second humidity, the first changing rate being an amount of change in the developing bias per unit time when the detector detects the first humidity, the second changing rate being an amount of change in the developing bias per unit time when the detector detects the second humidity.

According to an aspect of the disclosure, an image forming apparatus includes an image carrying member, a surface potential adjusting member configured to adjust a surface potential of the image carrying member, a transfer member configured to transfer a developer image formed on the image carrying member to a sheet passing between the image carrying member and the transfer member, a detector configured to detect a temperature, and a control device. The control device is configured to: change transfer bias to be applied to the transfer member from a first transfer bias to a second transfer bias in response to a sheet interval between the sheet and a next sheet; and change, in response to the sheet interval, a control amount of the surface potential adjusting member from a first control amount to a second control amount at a first changing rate when the detector detects a first temperature and at a second changing rate when the detector detects a second temperature, the control amount of the surface potential adjusting member contributing to fluctuations of the surface potential of a particular area, the first changing rate being an amount of change in the control amount of the surface potential adjusting member per unit time when the detector detects the first temperature, the second changing rate being an amount of change in the control amount of the surface potential adjusting member per unit time when the detector detects the second temperature.

According to an aspect of the disclosure, an image forming apparatus includes an image carrying member, a surface potential adjusting member configured to adjust a surface potential of the image carrying member, a transfer member configured to transfer a developer image formed on the image carrying member to a sheet passing between the image carrying member and the transfer member, a detector configured to detect a humidity, and a control device. The control device is configured to: change transfer bias to be applied to the transfer member from a first transfer bias to a second transfer bias in response to a sheet interval between the sheet and a next sheet; and change, in response to the sheet interval, a control amount of the surface potential adjusting member from a first control amount to a second control amount at a first changing rate when the detector detects a first humidity and at a second changing rate when the detector detects a second humidity, the control amount of the surface potential adjusting member contributing to fluctuations of the surface potential of a particular area, the first changing rate being an amount of change in the control amount of the surface potential adjusting member per unit time when the detector detects the first humidity, the second changing rate being an amount of change in the control amount of the surface potential adjusting member per unit time when the detector detects the second humidity.

BRIEF DESCRIPTION OF THE DRAWINGS

Illustrative aspects will be described in detail with reference to the following figures in which like elements are labeled with like numbers and in which:

FIG. 5 is a table showing time values to be set according to temperature and humidity;

DETAILED DESCRIPTION

An illustrative embodiment will be described in detail with reference to the accompanying drawings. In the following description, a general structure of a color laser printer 1, as an example of an image forming apparatus, will be described in detail.

In the following description, orientations or sides of the color laser printer 1 will be identified based on the color laser printer 1 disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
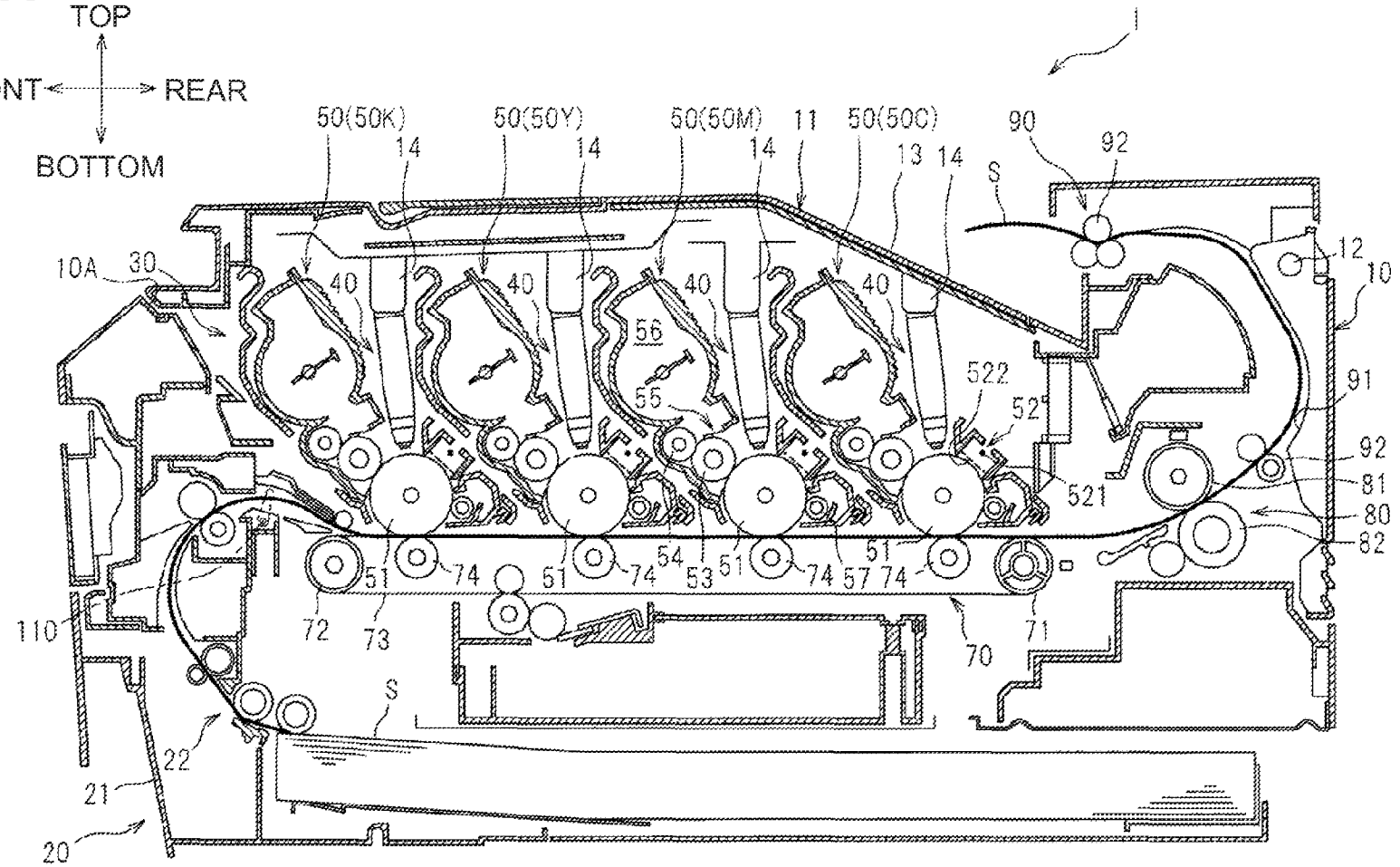
FIG. 1 is a sectional view of an illustrative image forming apparatus, e.g. a color laser printer, according to an embodiment of the disclosure.

As shown in FIG. 1, the color laser printer 1 includes a main casing 10, an upper cover 11, a sheet feed portion 20 configured to feed a sheet, e.g., plain paper, thick paper, a postcard, a thin paper, and a transparency sheet (hereinafter referred to as a sheet S), an image forming portion 30 configured to form an image on the sheet S fed thereto, and an ejection portion 90 configured to eject the sheet S on which the image is formed.

The upper cover 11 is disposed in an upper portion of the main casing 10, and configured to pivot about a shaft 12 disposed on the rear side such that a front side thereof moves vertically with respect to the main casing 10 to open and close an opening 10A formed in the upper portion of the main casing 10.

The sheet feed portion 20 is disposed in a lower portion of the main casing 10, and mainly includes a sheet tray 21 configured to accommodate sheets S therein, and a sheet feeding mechanism 22 configured to feed a sheet S from the sheet tray 31 tray 21 to the image forming portion 30. The sheets S in the sheet tray 21 are singly fed to the image forming portion 30 by the sheet feeding mechanism 22.

The image forming portion 30 includes four LED units 40, four process units 50, a transfer unit 70 and a fixing unit 80.

The LED units 40 are pivotally supported by the upper cover 11 via respective holding portions 14. When the upper cover 11 is closed, the LED units 40 are disposed facing photosensitive drums 51 from above. Each LED unit 40 is configured such that a light emitting portion (LED) disposed on an end thereof blinks based on image data to expose a charged surface of a corresponding one of the photosensitive drums 51.

The process units 50 are arranged in the front-rear direction between the upper cover 11 and the sheet tray 21, and configured to be attached to and removed from the main casing 10 vertically through the opening 10A of the main casing 10 exposed when the upper cover 11 is opened.

Each process unit 50 mainly includes a photosensitive drum 51 as an example of an image carrying member, a charger 52 as an example of a charging member, a developing roller 53 as an example of a developer carrying member, a supply roller 54, a layer-thickness regulating member 55, a toner chamber 56 storing positively chargeable toner as an example of a developer, and a cleaning roller 57.

The process units 50 include process units 50Y, 50M, 50C and 50K storing yellow toner, magenta toner, cyan toner and black toner respectively, which are arranged in this order from an upstream side in a sheet feeding direction.

Each photosensitive drum 51 includes a known cylindrical-shaped conductive drum body having a photosensitive layer formed on an outer surface thereof and a known shaft electrically continuous with the drum body, which is grounded.

The charger 52 is disposed corresponding to a photosensitive drum 51 and configured to adjust a surface potential of the photosensitive drum 51. The charger 52 mainly includes a wire electrode 521 and a grid electrode 522. The charger 52 is configured to generate a corona discharge through application of a charging bias (voltage) and charge the surface of the photosensitive drum 51 with a positive potential greater than a developing bias to be applied to the developing roller 53.

The developing roller 53 is disposed corresponding to a photosensitive drum 51 and carries toner on a surface thereof. The developing roller 53 is configured to, when contacting the photosensitive drum 51 while being subjected to a positive developing bias, supply toner to the photosensitive drum 51 (or an exposed area where the surface potential has become lower than the developing bias).

The cleaning roller 57 is disposed corresponding to a photosensitive drum 51 and configured to contact the photosensitive drum 51 and remove foreign matter, such as paper dust and toner, from the photosensitive drum 51. Specifically, during normal printing control, the cleaning roller 57 is subjected to a cleaning bias smaller than the surface potential of the photosensitive drum 51.

The transfer unit 70 is disposed between the sheet tray 21 and the process units 50, and mainly includes a drive roller 71, a driven roller 72, a conveyor belt 73, and four transfer rollers 74 as an example of a transfer member. The conveyor belt 73 is endless, extends between the drive roller 71 and the driven roller 72, and contacts the photosensitive drums 51 at its outer surface. The transfer rollers 74 are disposed inside the conveyor belt 73 such that the conveyor belt 73 is sandwiched between the transfer rollers 74 and the photosensitive drums 51. The transfer rollers 74 are ion conductive rollers.

The fixing unit 80 is disposed at the rear of the process units 50 and the transfer unit 70, and mainly includes a heat roller 81 and a pressure roller 82 disposed opposite to the heat roller 81 and configured to press the heat roller 81.

In the image forming portion 30, the surface of each photosensitive drum 51 is uniformly charged by a corresponding charger 52, and subsequently exposed to light by a corresponding LED unit 40. Thus, an electrostatic latent image based on image data is formed on the surface of each photosensitive drum 51.

Then, toner stored in the toner storing portion 56 is supplied to the developing roller 53 via the supply roller 54, enters in between the developing roller 53 and the layer thickness regulating blade 55, and is carried on the developing roller 53 as a thin layer having a fixed thickness. In this process, toner is charged frictionally and positively between the developing roller 53 and the supply roller 51 and between the developing roller 53 and the layer thickness regulating blade 55.

The toner carried on the developing roller 53 is supplied onto an exposed area on the photosensitive drum 51, thereby the electrostatic latent image is developed into a visible image such that a toner image is formed on the photosensitive drum 51. Then, when a sheet S is supplied from the sheet feed portion 20 and fed in between each of the photosensitive drums 51 and the conveyor belt 73 (contacting the transfer rollers 74, which are subjected to a negative transfer bias), the toner images carried on the surfaces of the photosensitive drums 51 are sequentially transferred onto the sheet S. The sheet S having the toner images transferred thereto passes between the heat roller 81 and the pressure roller 82 and the toner images transferred onto the sheet S are thermally fixed.

The ejection portion 90 mainly includes a guide configured to guide the sheet S fed from the fixing unit 80 along an ejection path 91, and feed rollers 92 configured to feed the sheet S. The sheet S having the toner images thermally fixed is fed along the ejection path 91 and ejected outside from the main casing 10, and received onto an ejection tray 13.

Figure 2:
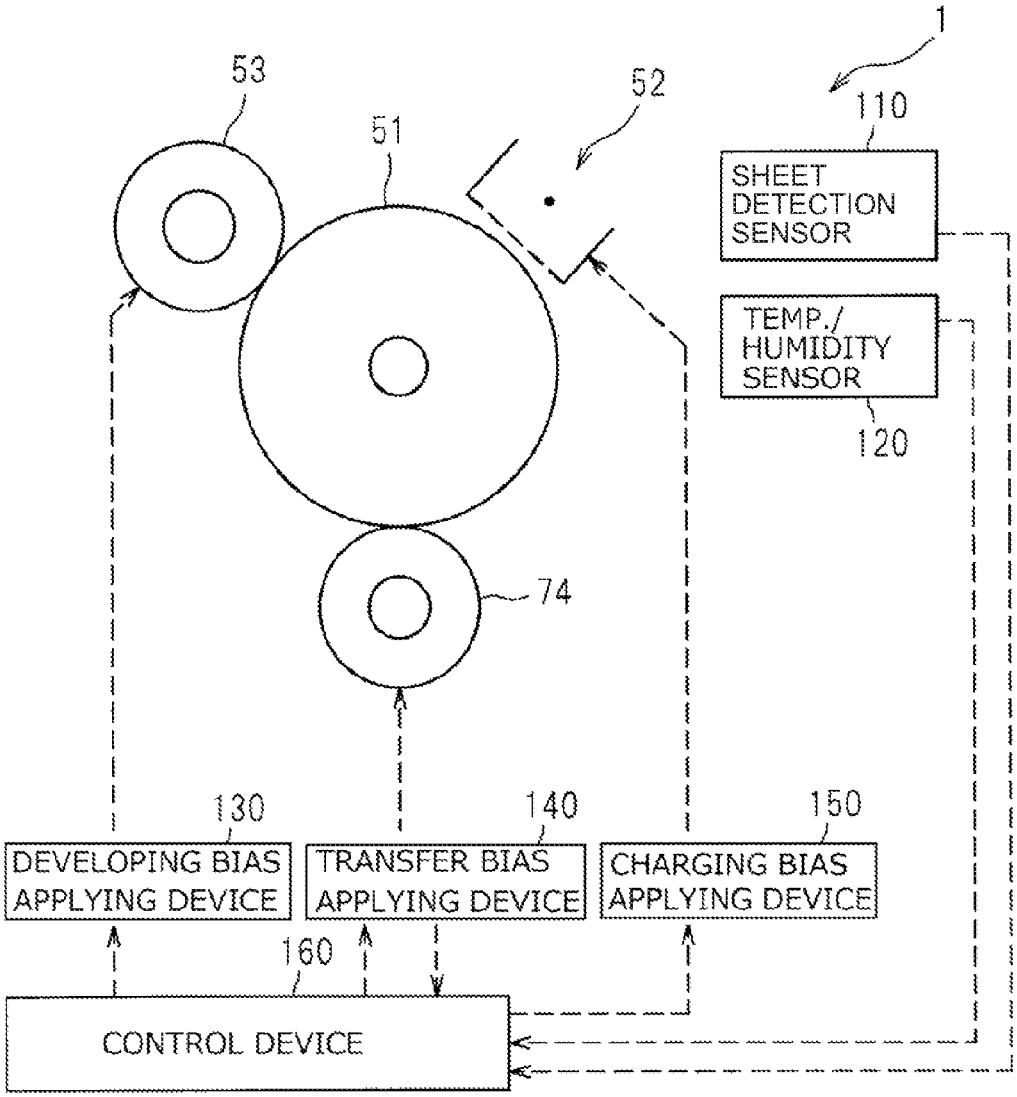
FIG. 2 schematically illustrates bias applying devices and a control device.

As shown in FIG. 2, the color printer 1 further includes a sheet detection sensor 110, a temperature/humidity sensor 120 as an example of a detector, a developing bias applying device 130, a transfer bias applying device 140, a charging bias applying device 150, and a control device 160. In FIG. 2, the conveyor belt 73 is omitted for the sake of convenience.

As shown in FIG. 1, the sheet detection sensor 110 is pivotally disposed upstream from the most upstream photosensitive drum 51. The sheet detection sensor 110 is configured to detect a passage of a leading end of a sheet S when the sheet detection sensor 110 is tilted from an upright position by the leading end of the sheet S, and detect a passage of a trailing end portion of the sheet S when the sheet detection sensor 110 kept tilted by a lower surface of the sheet S is returned to the upright position after the trailing end portion of the sheet S comes off the sheet detection sensor 110.

As shown in FIG. 2, the temperature/humidity sensor 120 is configured to detect temperature and humidity and is disposed in an appropriate position in the main casing 10.

The developing bias applying device 130 is configured to apply a developing bias to the developing rollers 53 and is controlled by the control device 160.

The transfer bias applying device 140 is configured to apply a transfer bias to the transfer rollers 74 and is controlled by the control device 160. The transfer bias applying device 140 includes a current sensor (not shown) configured to detect a transfer bias applied to the transfer rollers 74, which will be output to the control device 160. The transfer bias applying device 140 further includes a Zener diode, which prevents a current from flowing from the photosensitive drums 51 when the transfer bias applying device 140 stops applying the transfer bias to the transfer rollers 74.

The charging bias applying device 150 is configured to apply a charging bias to the chargers 52 and is controlled by the control device 160.

The control device 160 includes a central processing unit (CPU), a random access memory (RAM), a read-only memory (ROM), and an input/output interface, which are not shown. The control device 160 controls each part of the color laser printer 1 based on preset programs. Especially in the embodiment, the control device 160 controls the transfer bias applying device 140 and the developing bias applying device 130 based on signals from the sheet detection sensor 110 and the temperature/humidity sensor 120.

In the embodiment, the charging bias applying device 150 is controlled in a known manner, and detailed description thereof is omitted.

Figure 3A:
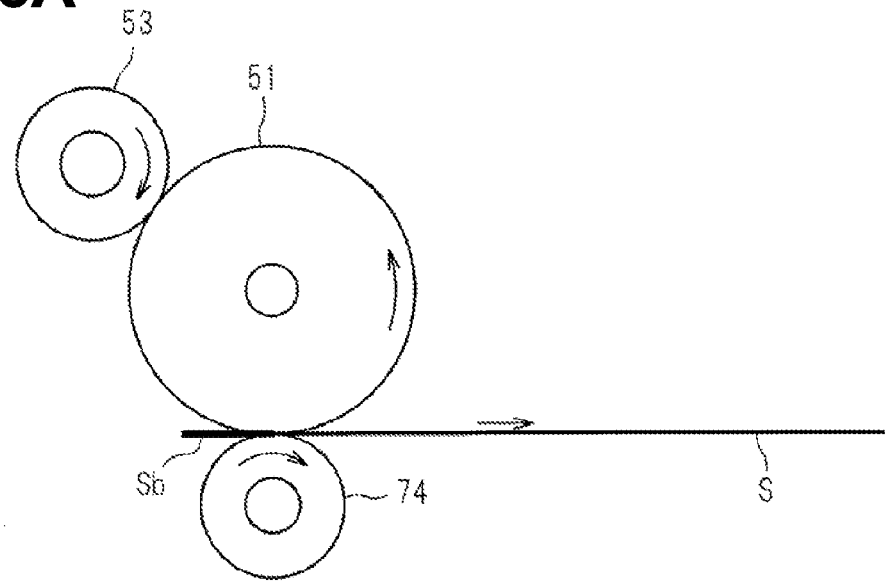
FIG. 3A illustrates a trailing end portion of a sheet reaches a transfer roller.

The control device 160 is configured to change a transfer bias to be applied to the transfer roller 74 in response to a sheet interval between the sheet S being fed and the next sheet S to be fed. Specifically, as shown in FIG. 3A, when a trailing end portion Sb (indicated with a thick line) of a sheet S passes between the photosensitive drum 51 and the transfer roller 74, the control device 160 is configured to change the transfer bias from a first transfer bias (−It1) to a second transfer bias (−It2) (see FIG. 4). The first transfer bias (−It1) is applied before the trailing end portion Sb of the sheet S passes between the photosensitive drum 51 and the transfer roller 74, and the second transfer bias (−It2) is smaller in absolute value than the first transfer bias (−It1). With this change, the potential for electric discharge between the trailing end portion Sb of the sheet S and the photosensitive drum 51 can be reduced.

The control device 160 is configured to determine whether the trailing end portion Sb of the sheet S reaches between the photosensitive drum 51 and the transfer roller 74 based on a signal from the sheet detection sensor 110, and then change the transfer bias. Specifically, the control device 160 determines whether a predetermined amount of time elapses after the sheet detection sensor 110 detects the passage of the leading or trailing end portion of the sheet S thereby determining whether the trailing end portion Sb of the sheet S reaches between the photosensitive drum 51 and the transfer roller 74.

Figure 3B:
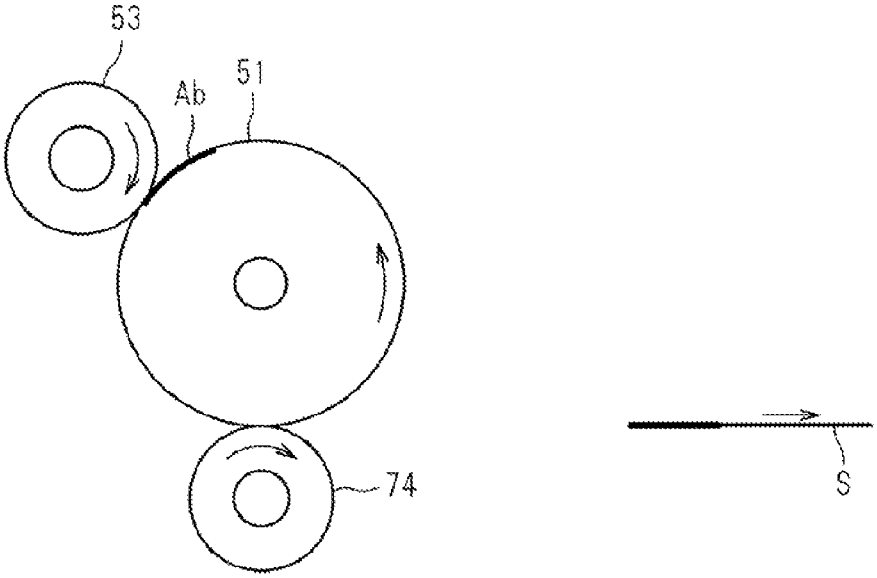
FIG. 3B illustrates a trailing end area reaches a developing roller.

The control device 160 is configured to change a developing bias to be applied to the developing roller 53 in response to the sheet interval. FIG. 3B shows that a trailing end area Ab on the photosensitive drum 51, which is indicated with a thick line in FIG. 3B, reaches the developing roller 53. The trailing end area Ab on the photosensitive drum 51 is an area corresponding to the trailing end portion Sb of the sheet having passed the transfer roller 74. Specifically, when the trailing end area Ab on the photosensitive drum 51 passes the developing roller 53 at the time when the transfer bias is at the second transfer bias (−It2), the control device 160 is configured to change the developing bias from a first bias Vd1 to a second developing bias Vd2 (see FIG. 4). The first developing bias Vd1 is applied to the developing roller 53 before the trailing end area Ab passes the developing roller 53. The second developing bias Vd2 is greater in absolute value than the first developing bias Vd1. With this structure, toner can be adequately supplied from the developing roller 53 to a part of the photosensitive drum 51 where the surface potential becomes high through the application of the second transfer bias (−It2).

The control device 160 is configured to change a developing bias by determining that the trailing end area Ab reaches the developing roller 53 based on a signal from the sheet detection sensor 110. Specifically, the control device 160 determines whether the trailing end area Ab reaches the developing roller 53 by determining whether a predetermined amount of time elapses after the trailing end portion Sb of the sheet S reaches between the photosensitive drum 51 and the transfer roller 74.

Furthermore, the control device 160 is configured such that a first time T1 for changing the developing bias from the first developing bias Vd1 to the second developing bias Vd2 and a second time T2 for changing the developing bias from the second developing bias Vd2 to the first developing bias Vd1 are longer as the temperature and humidity detected by the temperature/humidity sensor 120 are lower. Specifically, the control device 160 is configured to set the times T1 and T2 based on the temperature and the humidity detected by the temperature/humidity sensor 120 and a table stored in memory (not shown), which is shown in FIG. 5.

For example, when the temperature Th is 15-20 degrees Celsius and the humidity H is 45-55% (or when it is in the normal temperature and normal humidity environment), the control device 160 sets each of the times T1 and T2 to 5 ms from the table shown in FIG. 5. When it is in the low temperature and low humidity environment, for example, when the temperature Th is 10 degrees Celsius or less and the humidity H is 25% or less, the control device 160 sets each of the times T1 and T2 to 25 ms from the table shown in FIG. 5.

Figure 4:
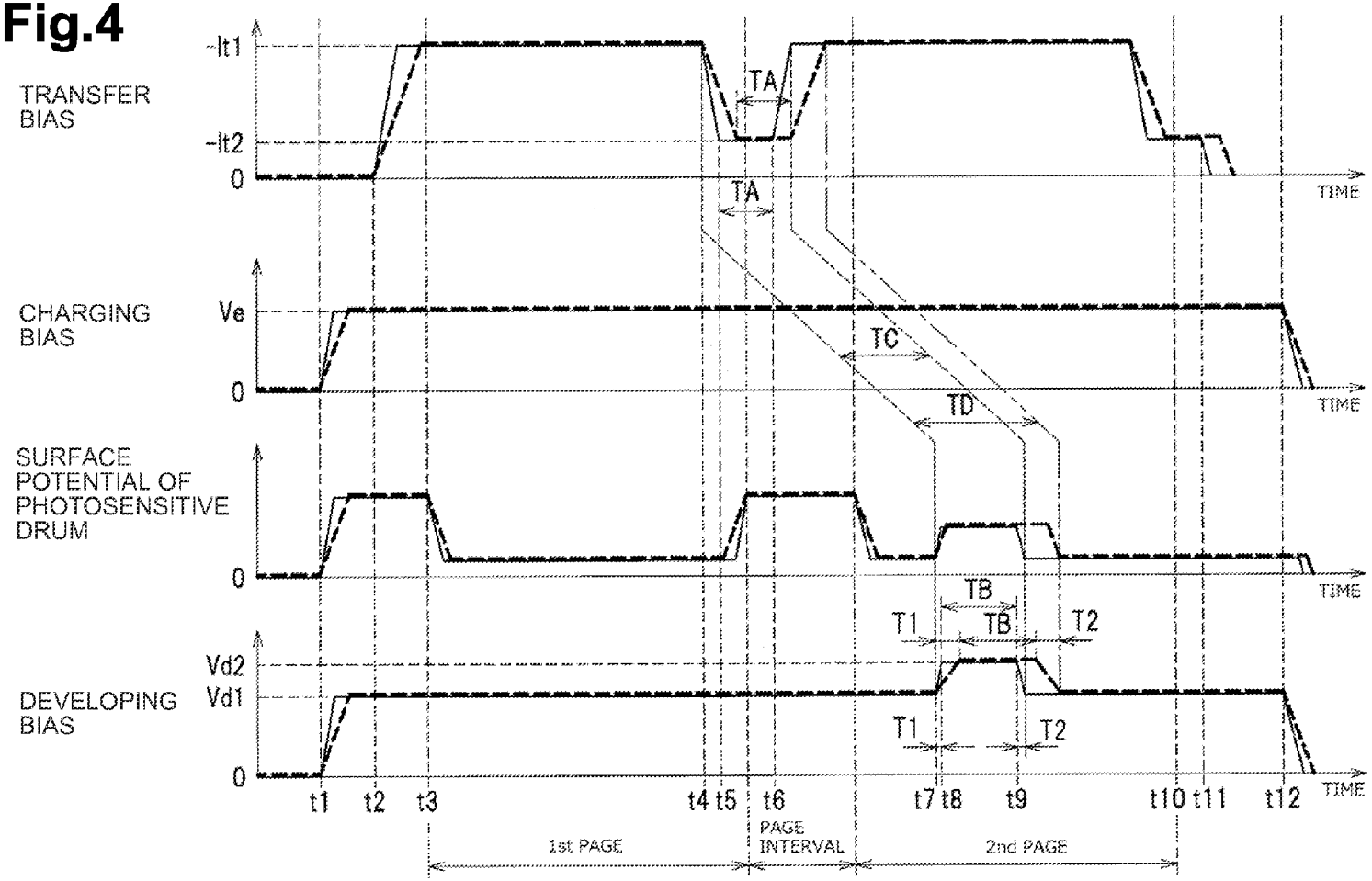
FIG. 4 is a time chart illustrating changes of biases and a surface potential of a photosensitive drum.

Values in the table shown in FIG. 5 are determined as appropriate based on results of experiments and simulations. Specifically, the times T1 and T2 are set such that a time for changing a developing bias becomes equal to a time for changing a transfer bias, which changes according to environmental change, as shown in FIG. 4. For example, time TC is a time for changing the transfer bias or the developing bias in the normal temperature and normal humidity environment, which is indicated with a solid line, and time TD is a time for changing the transfer bias or the developing bias in the low temperature and low humidity environment, indicated with a broken line.

Here "the time for changing the transfer bias" refers to a period of time from when the transfer bias is changed from the first transfer bias (−It1) to the second transfer bias (−It2) till when the transfer bias is returned to the first transfer bias (−It1). "The time for changing the developing bias" refers to a period of time from when the developing bias is changed from the first developing bias Vd1 to the second developing bias Vd2 till when the developing bias is returned to the first developing bias Vd1.

Time TA for maintaining the transfer bias at the second transfer bias (−It2) and time TB for maintaining the developing bias at the second developing bias Vd2 are set unchanged in any environments. The gradients of the transfer bias in ascending and descending (or time until when a target value is obtained) are subject to change according to various environments, and the times T1 and T2 are set accordingly. The gradients of the transfer bias indicate an amount of change in the transfer bias per unit time.

In other words, while the gradients of the transfer bias are naturally changed in relation to the environmental changes, the gradients of the developing bias (indicating an amount of change in the developing bias per unit time) are controlled such that they are forcibly changed. The gradients of the developing bias are changed by the times T1 and T2 set in relation to the environmental changes. For example, even when time TC for changing the transfer bias in the normal temperature and normal humidity environment is changed to time TD for changing the transfer bias in the low temperature and low humidity environment, which is longer than the time TC, time TC for changing the developing bias in the normal temperature and normal humidity environment can be changed to have substantially the same period of time as the time TD. Thus, developer can be adequately supplied from the developing roller 53 to the photosensitive drum 51 and thus inconsistency in density can be reduced.

Figure 6:
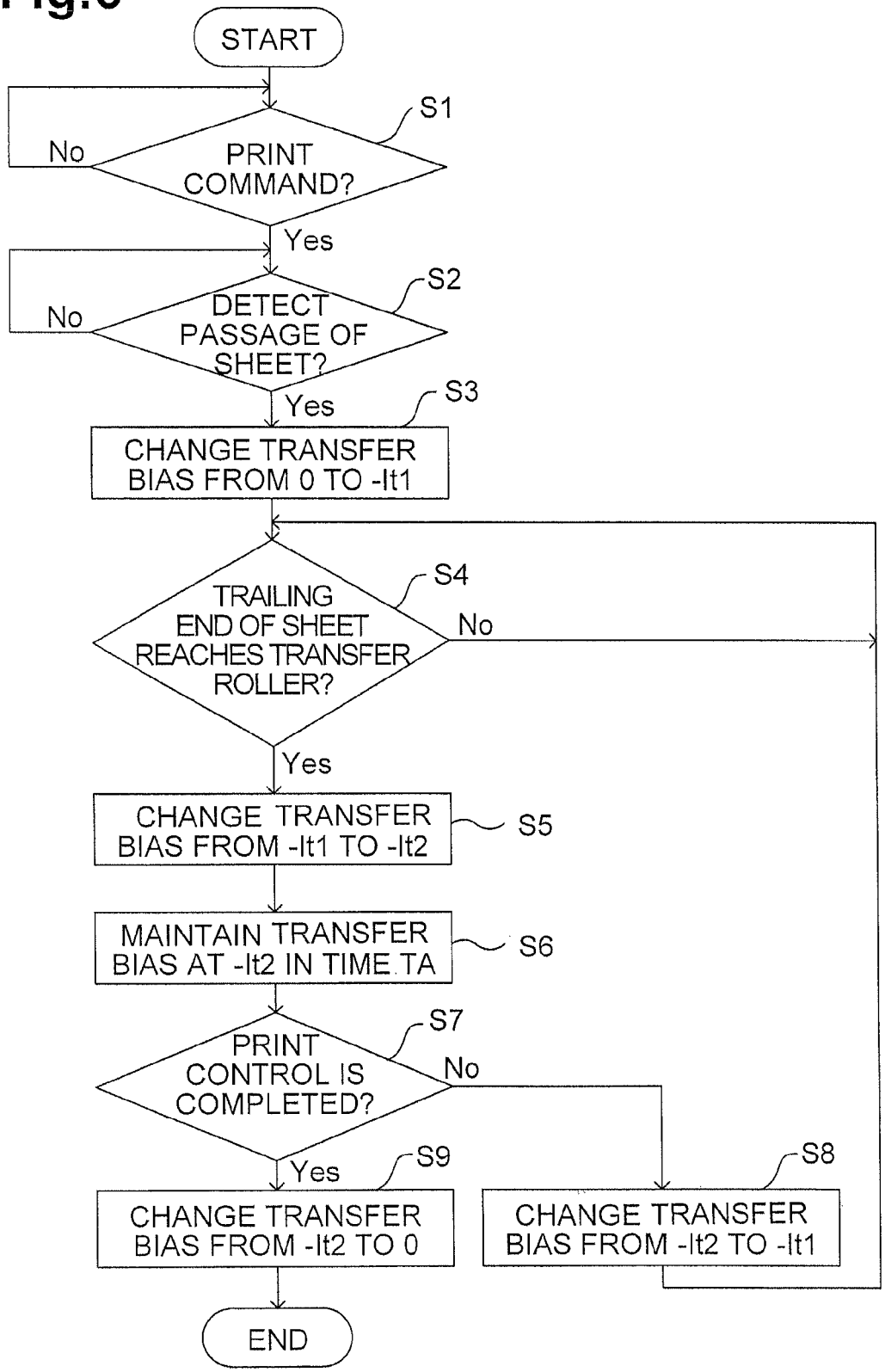
FIG. 6 is a flowchart illustrating a process for controlling a transfer bias.
Figure 7:
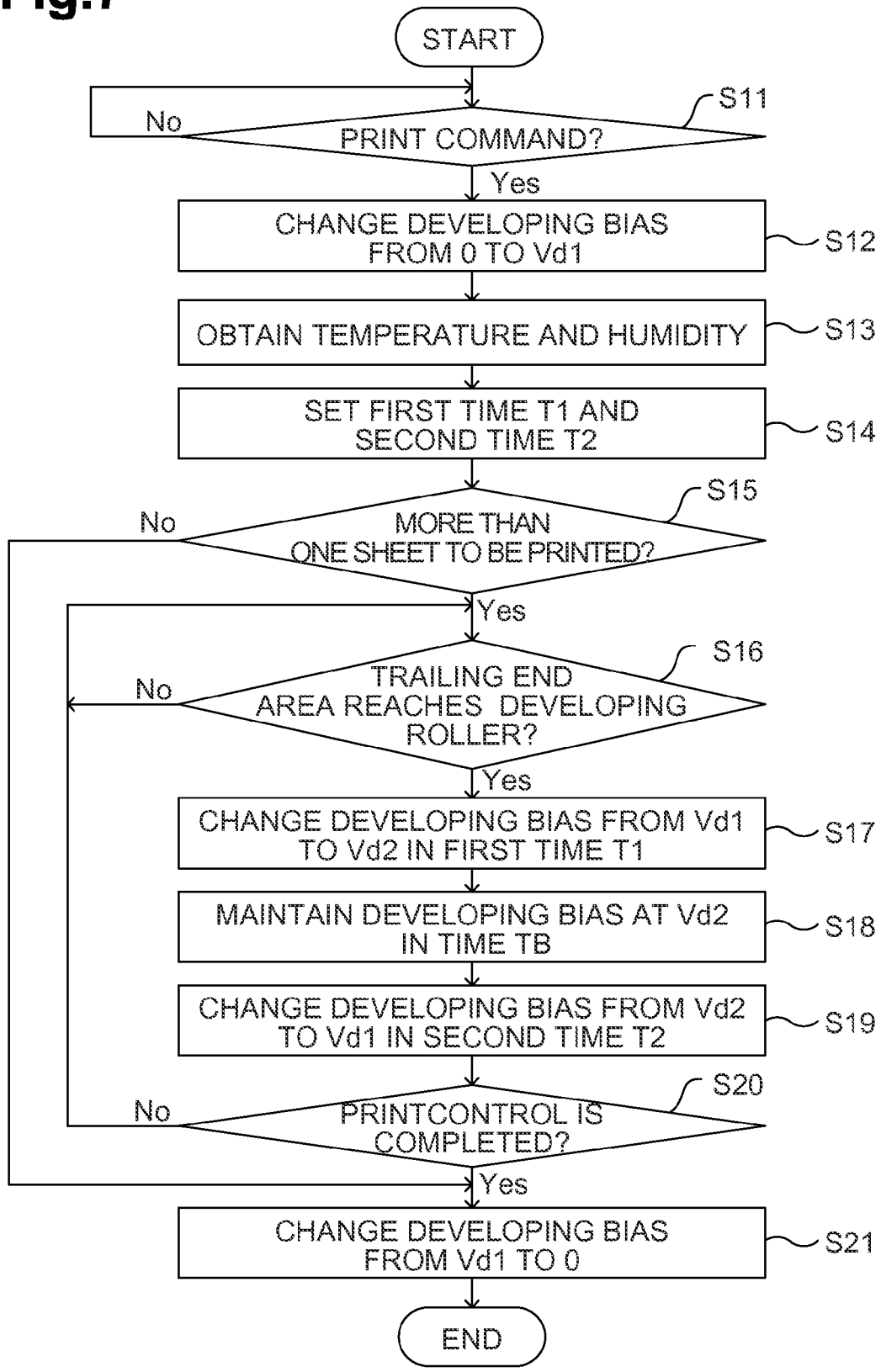
FIG. 7 is a flowchart illustrating a process for controlling a developing bias.

Specifically, the control device 160 executes control of the transfer bias in accordance with the flowchart shown in FIG. 6, and control of the developing bias in accordance with the flowchart shown in FIG. 7.

The control of the transfer bias will be described with reference to FIG. 6.

The control device 160 first determines whether there is a print command (step S1). When there is a print command (step S1: Yes), the control device 160 determines whether the sheet detection sensor 110 detects a passage of a sheet S (step S2).

When the sheet detection sensor 110 detects the passage of the sheet S (step S2: Yes), the control device 160 changes the transfer bias from 0 (off state) to the first transfer bias (−It1) (step S3). After step S3, the control device 160 determines whether the trailing end portion Sb of the sheet S reaches the transfer roller 74 (step S4).

When the control device 160 determines that the trailing end portion Sb of the sheet S reaches the transfer roller 74 (step S4: Yes), the control device 160 changes the transfer bias from the first transfer bias (−It1) to the second transfer bias (−It2) (step S5). After step S5, the control device 160 monitors whether the transfer bias becomes −It2 based on information from a voltage sensor, and maintains the transfer bias at −It2 for the fixed period of time TA since the transfer bias becomes −It2 (step S6).

After step S6, the control device 160 determines whether a print control is completed or a next sheet S to be printed is present (step S7). When the print control is not completed (step S7: No), the control device 160 returns the transfer bias from −It2 to −It1 (step S8) and returns to S4.

When the control device 160 determines that the print control is completed (step S7: Yes), the control device 160 returns the transfer bias from −It2 to 0 (off state) (step S9), and ends the control of the transfer bias.

The control of the developing bias will be described with reference to FIG. 7.

The control device 160 first determines whether there is a print command (step S11). When there is a print command (step S11), the control device 160 changes the developing bias from 0 (off state) to the first developing bias Vd1 (step S12).

After step S12, the control device 160 obtains a temperature and a humidity from the temperature/humidity sensor 120 (step S13), and sets the first time T1 and the second time T2 based on the temperature, the humidity and the table shown in FIG. 5 (step S14). After step S14, the control device 160 determines whether the number of sheets to be printed is more than one based on the print command (step S15).

When the control device 160 determines that the number of sheets to be printed is more than one (step S15: Yes), the control device 160 determines whether the trailing end area Ab on the photosensitive drum 51 (that is an area corresponding to the trailing end portion Sb of the sheet S) reaches the developing roller 53 (step S16). When the control device 160 determines that the trailing end area Ab reaches the developing roller 53 (step S16: Yes), the control device 160 changes the developing bias from the first developing bias Vd1 to the second developing bias Vd2 in the first time T1 (step S17).

Specifically, in step S17, the control device 160 sets plural target developing bias values such that the developing bias is changed in stages only by a minute bias amount in a short time period. In other words, the developing bias is increased by (Vd2−Vd1)/T1 per unit time.

After step S17 or after the developing bias becomes Vd2, the control device 160 maintains the developing bias at Vd2 for the fixed period of time TB (step S18). After step S18, the control device 160 changes the developing bias from Vd2 to Vd1 in the second time T2 (step S19).

Even in step S19, as in the case of step S17, the control device 160 sets plural target developing bias values such that the developing bias is changed in stages only by a minute bias amount in a short time period.

After step S19, the control device 160 determines whether the print control is completed or a next sheet S to be printed is present (step S20). When the print control is not completed (step S20: No), the control device 160 returns to step S16.

When the control device 160 determines that the print control is completed (step S20: Yes) or when the control device 160 determines that the number of sheets to be printed is one (step S15: No), the control device 160 returns the developing bias from Vd1 to 0 (off state) (step S21) and ends the control of the developing bias.

Next, the operation of the control device 160 when two sheets of a halftone image are successively printed in the normal temperature and normal humidity environment and the low temperature and low humidity environment will be described with reference to FIG. 4.

In the normal temperature and normal humidity environment indicated with solid lines in FIG. 4, when receiving a print command (time t1), the control device 160 changes the developing bias from 0V to the first developing bias Vd1 and changes the charging bias from 0V to a specified charging bias Ve.

When detecting a passage of a leading end of a sheet S (time t2), the control device 160 changes the transfer bias from 0 (off state) to −It1. Then, after detecting the passage of the leading end of the sheet S, the control device 160 starts a print control for a first page at a specified time (time t3).

When the trailing end portion Sb of the sheet S reaches the transfer roller 74 (time t4), the control device 160 changes the transfer bias from −It1 to −It2. When the transfer bias reaches −It2 (time t5), the control device 160 maintains the transfer bias at −It2 for the fixed period of time TA. After the fixed period of time TA elapses (time t6), the control device 160 returns the transfer bias from −It2 to −It1.

When trailing end area Ab on the photosensitive drum 51 reaches the developing roller 53 (time t7), the control device 160 changes the developing bias from Vd1 to Vd2 in the first time T1, which is set based on the temperature and the humidity. After the first time T1 elapses (time t8), the control device 160 maintains the developing bias at Vd2 for the fixed period of time TB.

After the fixed period of time TB elapses (time t9), the control device 160 returns the developing bias from Vd2 to Vd1 in the second time T2, which is set based on the temperature and the humidity. Then, when the print control of a final page (or a second page in FIG. 4) is completed (time t10), the control device 160 maintains the transfer bias at −It2 for the fixed period of time TA and then returns the transfer bias from −It2 to 0 (off state) (time t11).

After setting the transfer bias to the off state, the control device 160 returns the developing bias from Vd1 to 0 (off state) and returns the charging bias from Ve to 0 (off state) at a specified time (time t12).

In the low temperature and low humidity environment indicated with broken lines in FIG. 4, the gradients of when the transfer bias is changed from −It1 to −It2 (or from −It2 to −It1) become gentle more than those in the normal temperature and normal humidity environment (solid lines), and the time for changing the transfer bias becomes the time TD, which is longer than the time TC set in the normal temperature and normal humidity environment.

In the embodiment, as the first time T1 and the second time T2 for changing the developing bias are set to be longer in the low temperature and low humidity environment than in the normal temperature and normal humidity environment, the time for changing the developing bias in the low temperature and low humidity environment can be set to the time TD, which is the same as the time for changing the transfer bias in the low temperature and low humidity environment. Thus, as toner can be adequately supplied to all the trailing end area Ab on the photosensitive drum 51 (specifically, to an exposed portion of the trailing end area Ab) having a length corresponding to the time TD for changing the transfer bias, through the application of the second developing bias Vd2 greater than the first developing bias Vd1, inconsistency in density can be reduced.

Especially in the embodiment, as the transfer rollers 74 are ion conductive rollers, namely, made of a material whose resistance is changeable by changes of the temperature and humidity, the time for changing the transfer bias is changeable by the changes of the temperature and humidity. However, the disclosure is advantageous in applying the disclosure to such a structure.

The disclosure is not limited to the above embodiment. The disclosure can be applied in various embodiments described below. It is noted that, in the following description, elements similar to or identical with those shown and described in the above embodiment are designated by similar numerals, and thus the description thereof can be omitted for the sake of brevity.

Figure 8:
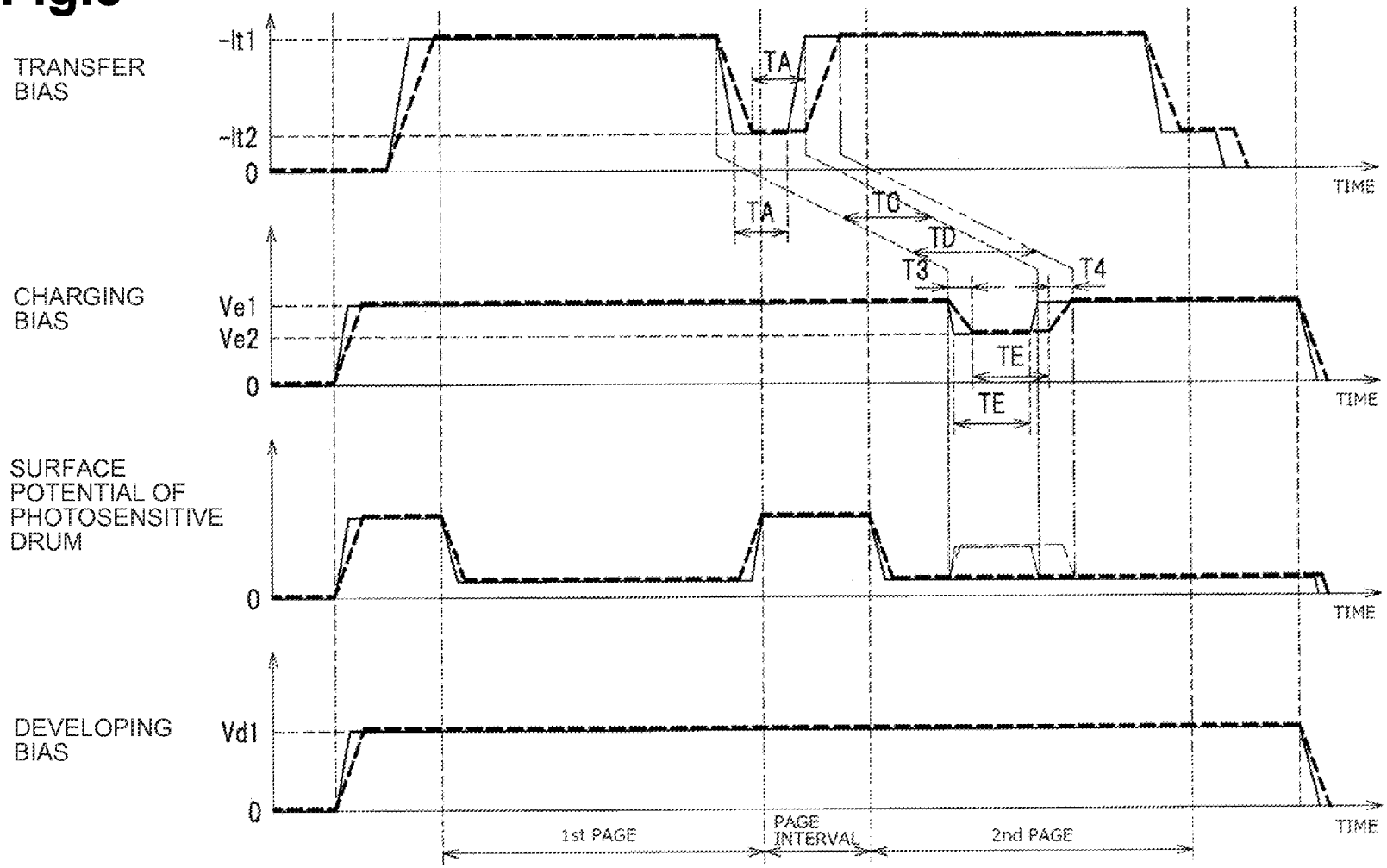
FIG. 8 is a time chart for changing a charging bias to reduce electrical discharge.

The above embodiment shows, but is not limited to, that an electrostatic discharge between the trailing end portion Sb of the sheet S and the photosensitive drum 51 is reduced by changing the developing bias. The electrostatic discharge may be reduced by changing a control amount of a surface potential adjusting member configured to adjust a surface potential of the photosensitive drum 51, for example. Specifically, in a case where the charger 52 is used as the surface potential adjusting member, the charging bias, which is the control amount of the charger 52, may be changed as shown in FIG. 8.

The control device 160 is configured to change the charging bias in response to the sheet interval. Specifically, the control device 160 is configured to change the charging bias between a first charging bias Ve1 and a second charging bias Ve2 such that, when the trailing end area Ab on the photosensitive drum 51 passes the charger 52, a surface potential in the trailing end area Ab conforms to a surface potential in an area downstream from the trailing end area Ab in a rotation direction of the photosensitive drum 51. The charging bias contributes to fluctuations of the surface potential in the trailing end area Ab. The control device 160 is configured to set a third time T3 and a fourth time T4 to be longer as the temperature and humidity detected by the temperature/humidity sensor 120 are lower. The third time T3 is a time for changing the charging bias from the first charging bias Ve1 to the second charging bias Ve2, and the fourth time T4 is a time for changing the charging bias from the second charging bias Ve2 to the first charging bias Ve1.

Figure 9:
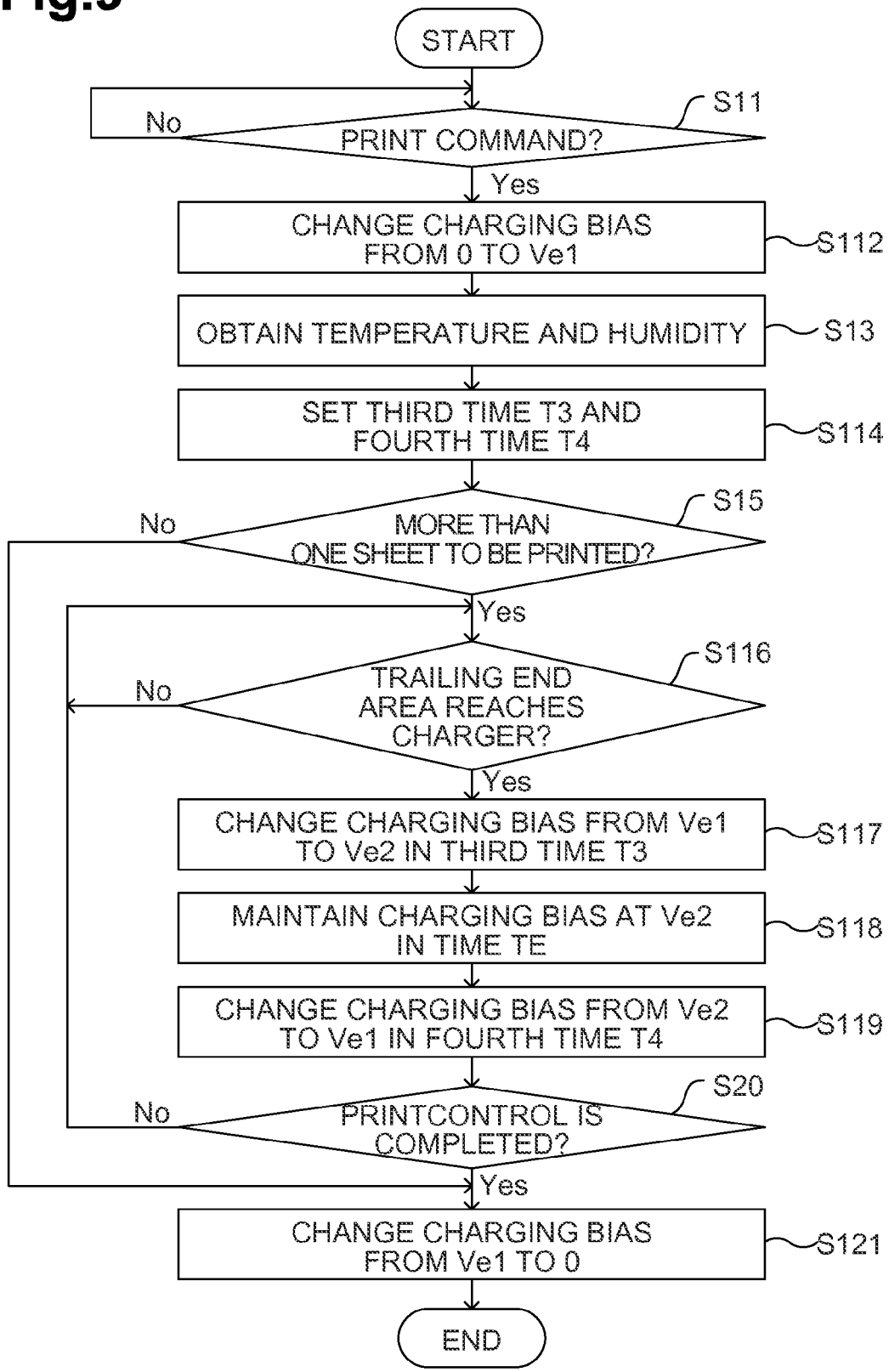
FIG. 9 is a flowchart illustrating a process for controlling the charging bias.

The control device 160 executes control of the charging bias based on a flowchart shown in FIG. 9. The flowchart in FIG. 9 is different from that in FIG. 7 in that a first charging bias Ve1, a second charging bias Ve2, the third time, the fourth time, the charger, a fixed period of time TE are used instead of the first developing bias Vd1, the second developing bias Vd2, the first time, the second time, the developing roller, the fixed period of time TB in the flowchart of FIG. 7. It is noted that in FIG. 9 steps identical with those shown in and described with reference to FIG. 7 are designated by identical step numbers and thus the description thereof can be omitted for the sake of brevity. In FIG. 9, the gradients of the charging bias indicate an amount of change in the charging bias per unit time.

When the control device 160 determines Yes in step S11, it changes the charging bias from 0 (off state) to the first charging bias Ve1 in step S112 and proceeds to step S13. After step S13, the control device 160 sets the third time T3 and the fourth time T4 based on the temperature and the humidity obtained in step S13 (step S114).

After step S114, the control device 160 proceeds to step S15. When the control device 160 determines Yes in step S15, it determines whether the trailing end area Ab on the photosensitive drum 51 reaches the charger 52 (S116).

When the control device 160 determines that the trailing end area Ab on the photosensitive drum 51 reaches the charger 52 (step S116: Yes), the control device 160 changes the charging bias from the first charging bias Ve1 to the second charging bias Ve2 in the third time T3 (step S117). After step S117 or after the charging bias becomes Ve2, the control device 160 maintains the charging bias at Ve2 for the fixed period of time TE (step S118).

After step S118, the control device 160 changes the charging bias from Ve2 to Ve1 in the fourth time T4 (step S119). After step S119, the control device 160 executes step S20, and changes the charging bias from Ve1 to 0 (off state) (step S121).

When the temperature and the humidity become low and the time for changing the transfer bias becomes longer, the time T3 where the charging bias is changed from Ve1 to e2 and the time T4 where the charging bias is changed from Ve2 to Ve1 become longer accordingly. Thus, a time from when the charging bias is changed from the first charging bias Ve1 to the second charging bias Ve2 till when the charging bias is returned from the second charging bias ve2 to the first charging bias Ve1 (that is, the time for changing the charging time) can conform to the time for changing the transfer bias (see FIG. 8). This can reduce a possibility of generating a difference in surface potential of the photosensitive drum 51, resulting in reduction of inconsistency in density.

The above embodiment shows, but is not limited to, that the charger 52 is used as a charging member. The charging member may include a charging roller.

The above embodiment show, but is not limited to, that the charging member is used as the surface potential adjusting member. The surface potential adjusting member may include the cleaning roller 57 and a static eliminating member provided between the transfer roller and the cleaning roller. In a case where the cleaning roller 57 is used, the first control amount may be set to the first cleaning bias and the second control amount may be set to the second cleaning bias. In a case where the static eliminator is used, the first control amount may be set to the first luminous intensity and the second control amount may be set to the second luminous intensity.

The above embodiment shows, but is not limited to, that the second transfer bias (−It2) is set to a value other than 0.

The control device may be configured to change the second transfer bias to 0 by stopping applying the transfer bias to the transfer member when the trailing end portion of the sheet passes between the image carrying member and the transfer member. When the transfer bias is changed to 0 (OFF state) to ON state, a start-up may get slow in the low-temperature and low humidity environment and the time for changing the transfer bias may get longer compared with a case where the value for the transfer bias is simply changed. Thus, the disclosure is advantageous especially when the second transfer bias is set to 0 by stopping applying the transfer bias to the transfer member.

The above embodiments show, but are not limited to, that the first time and the second time or the third time and the fourth time are set to have the same time. The first time and the second time or the third time and the fourth time may be set to have a different time. The above embodiments show, but are not limited to, that both of the first time and the second time or both of the third time and the fourth time are set. One of them may be set according to the temperature and the humidity, and the other one of them may not be set.

The above embodiments show, but are not limited to, that the temperature/humidity sensor 120 is used as a detector. The detector may include a sensor configured to detect a change in resistance in a nip portion between the transfer roller and the photosensitive drum as a change in the temperature and the humidity.

The above embodiments show, but are not limited to, positive chargeable toner. Negative chargeable toner may be used by inverting sign (negative or positive) of each bias and the surface potential in the above embodiments.

The above embodiments show, but are not limited to, the color laser printer 1 as an electrophotographic image forming apparatus according to aspects of the disclosure. The image forming apparatus may include a copier, a multifunction apparatus and other apparatus.

The above embodiments show, but are not limited to, the photosensitive drum 51 as an image carrying member. The image carrying member may include a belt-shaped photosensitive member.

The above embodiments show, but are not limited to, the transfer roller 74 as a transfer member. The transfer member may include a conductive brush and a conductive spring which may be subject to the transfer bias.

The above embodiments show, but are not limited to, that that the first time and the second time or the third time and the fourth time are set based on the temperature and the humidity detected by the temperature/humidity sensor 120. The first time and the second time or the third time and the fourth time may be set based on the temperature or the humidity detected by the sensor 120.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image carrying member;

a developer carrying member configured to carry developer to be supplied to the image carrying member;

a transfer member configured to transfer a developer image formed on the image carrying member to a sheet passing between the image carrying member and the transfer member;

a detector configured to detect a temperature; and a processor comprising hardware configured to:

change a transfer bias to be applied to the transfer member from a first transfer bias to a second transfer bias being smaller in absolute value than the first transfer bias and not zero in response to a sheet interval between the sheet and a next sheet;

(a) when the detector detects a first temperature, control a developing bias to be applied to the developer carrying member in response to the sheet interval by:

gradually increasing the developing bias from a first developing bias to a second developing bias greater in absolute value than the first developing bias at a first developing bias increasing changing rate, the first developing bias increasing changing rate being an amount of increase in the developing bias per unit time, the first developing bias increasing changing rate being constant and linear;

maintaining, for a fixed period of time, the developing bias at the second developing bias; and gradually decreasing the developing bias from the second developing bias to the first developing bias at a first developing bias decreasing changing rate, the first developing bias decreasing changing rate being an amount of decrease in the developing bias per unit time, the first developing bias decreasing changing rate being constant and linear; and (b) when the detector detects a second temperature being lower than the first temperature, control the developing bias in response to the sheet interval by:

gradually increasing the developing bias from the first developing bias to the second developing bias at a second developing bias increasing changing rate, the second developing bias increasing changing rate being an amount of increase in the developing bias per unit time, the second developing bias increasing changing rate being constant and linear, an absolute value of the second developing bias increasing changing rate being less than an absolute value of the first developing bias increasing changing rate;

maintaining, for the fixed period of time, the developing bias at the second developing bias; and gradually decreasing the developing bias from the second developing bias to the first developing bias at a second developing bias decreasing changing rate, the second developing bias decreasing changing rate being an amount of decrease in the developing bias per unit time, the second developing bias decreasing changing rate being constant and linear, an absolute value of the second developing bias decreasing changing rate being less than an absolute value of the first developing bias decreasing changing rate.

2. The image forming apparatus according to claim 1, wherein the detector is configured to further detect a humidity, and wherein the processor comprising hardware is configured to gradually increase the developing bias from the first developing bias to the second developing bias at the first developing bias increasing changing rate when the detector detects a first humidity and at the second developing bias increasing changing rate when the detector detects a second humidity being lower than the first humidity.

3. The image forming apparatus according to claim 1, wherein the processor comprising hardware is configured to change the transfer bias from the second transfer bias to zero.

4. The image forming apparatus according to claim 1, wherein the transfer member includes an ion conductive roller.

5. The image forming apparatus according to claim 1, wherein the processor comprising hardware is configured to:

(a) when the detector detects the first temperature, control the transfer bias in response to the sheet interval by:

gradually decreasing the transfer bias from the first transfer bias to the second transfer bias at a first transfer bias decreasing changing rate, the first transfer bias decreasing changing rate being an amount of decrease in the transfer bias per unit time, the first transfer bias decreasing changing rate being constant and linear;

maintaining, for a first fixed period of time, the transfer bias at the second transfer bias; and gradually increasing the transfer bias from the second transfer bias to the first transfer bias at a first transfer bias increasing changing rate, the first transfer bias increasing changing rate being an amount of increase in the transfer bias per unit time, the first transfer bias increasing changing rate being constant and linear; and (b) when the detector detects a second temperature being lower than the first temperature, control the transfer bias in response to the sheet interval by:

gradually decreasing the transfer bias from the first transfer bias to the second transfer bias at a second transfer bias decreasing changing rate, the second transfer bias decreasing changing rate being an amount of decrease in the transfer bias per unit time, the second transfer bias decreasing changing rate being constant and linear, an absolute value of the second transfer bias decreasing changing rate being less than an absolute value of the first transfer bias decreasing changing rate;

maintaining, for the first fixed period of time, the transfer bias at the second transfer bias; and gradually increasing the transfer bias from the second transfer bias to the first transfer bias at a second transfer bias increasing changing rate, the second transfer bias increasing changing rate being an amount of increase in the transfer bias per unit time, the second transfer bias increasing changing rate being constant and linear, an absolute value of the second transfer bias increasing changing rate being less than an absolute value of the first transfer bias increasing changing rate.

6. An image forming apparatus comprising:

an image carrying member;

a developer carrying member configured to carry developer to be supplied to the image carrying member;

a transfer member configured to transfer a developer image formed on the image carrying member to a sheet passing between the image carrying member and the transfer member;

a detector configured to detect a humidity; and a processor comprising hardware configured to:

change a transfer bias to be applied to the transfer member from a first transfer bias to a second transfer bias being smaller in absolute value than the first transfer bias and not zero in response to a sheet interval between the sheet and a next sheet;

(a) when the detector detects a first humidity, control a developing bias to be applied to the developer carrying member in response to the sheet interval by:

gradually increasing the developing bias from a first developing bias to a second developing bias greater in absolute value than the first developing bias at a first developing bias increasing changing rate, the first developing bias increasing changing rate being an amount of increase in the developing bias per unit time, the first developing bias increasing changing rate being constant and linear;

maintaining, for a fixed period of time, the developing bias at the second developing bias; and gradually decreasing the developing bias from the second developing bias to the first developing bias at a first developing bias decreasing changing rate, the first developing bias decreasing changing rate being an amount of decrease in the developing bias per unit time, the first developing bias decreasing changing rate being constant and linear; and (b) when the detector detects a second humidity being lower than the first humidity, control the developing bias in response to the sheet interval by:

gradually increasing the developing bias from the first developing bias to the second developing bias at a second developing bias increasing changing rate, the second developing bias increasing changing rate being an amount of increase in the developing bias per unit time, the second changing rate being constant and linear, an absolute value of the second developing bias increasing changing rate being less than an absolute value of the first developing bias increasing changing rate;

maintaining, for the fixed period of time, the developing bias at the second developing bias; and gradually decreasing the developing bias from the second developing bias to the first developing bias at a second developing bias decreasing changing rate, the second developing bias decreasing changing rate being an amount of decrease in the developing bias per unit time, the second developing bias decreasing changing rate being constant and linear, an absolute value of the second developing bias decreasing changing rate being less than an absolute value of the first developing bias decreasing changing rate.

7. The image forming apparatus according to claim 6, wherein the detector is configured to further detect a temperature, and wherein the processor comprising hardware is configured to gradually increase the developing bias from the first developing bias to the second developing bias at the first developing bias increasing changing rate when the detector detects a first temperature and at the second developing bias increasing changing rate when the detector detects a second temperature being lower than the first temperature.

8. The image forming apparatus according to claim 6, wherein the processor comprising hardware is configured to change the transfer bias from the second transfer bias to zero.

9. The image forming apparatus according to claim 6, wherein the transfer member includes an ion conductive roller.

10. An image forming apparatus comprising:

an image carrying member;

a charging member configured to charge a surface of the image carrying member;

a transfer member configured to transfer a developer image formed on the image carrying member to a sheet passing between the image carrying member and the transfer member;

a detector configured to detect a temperature; and a processor comprising hardware configured to:

change a transfer bias to be applied to the transfer member from a first transfer bias to a second transfer bias being smaller in absolute value than the first transfer bias and not zero in response to a sheet interval between the sheet and a next sheet;

(a) when the detector detects a first temperature, control a charging bias to be applied to the charging member in response to the sheet interval by:

gradually decreasing the charging bias from a first charging bias to a second charging bias being smaller in absolute value than the first charging bias at a first charging bias decreasing changing rate, the first charging bias decreasing changing rate being an amount of decrease in the charging bias per unit time, the first charging bias decreasing changing rate being constant and linear;

maintaining, for a fixed period of time, the charging bias at the second charging bias; and gradually increasing the charging bias from the second charging bias to the first charging bias at a first charging bias increasing changing rate, the first charging bias increasing changing rate being an amount of increase in the charging bias per unit time, the first charging bias increasing changing rate being constant and linear; and (b) when the detector detects a second temperature being lower than the first temperature, control the charging bias in response to the sheet interval by:

gradually decreasing the charging bias from the first charging bias to the second charging bias at a second charging bias decreasing changing rate, the second charging bias decreasing changing rate being an amount of decrease in the charging bias per unit time, the second charging bias decreasing changing rate being constant and linear, an absolute value of the second charging bias decreasing changing rate being less than an absolute value of the first charging bias decreasing changing rate;

maintaining, for the fixed period of time, the charging bias at the second charging bias; and gradually increasing the charging bias from the second charging bias to the first charging bias at a second charging bias increasing changing rate, the second charging bias increasing changing rate being an amount of increase in the charging bias per unit time, the second charging bias increasing changing rate being constant and linear, an absolute value of the second charging bias increasing changing rate being less than an absolute value of the first charging bias increasing changing rate.

11. The image forming apparatus according to claim 10, wherein the detector is configured to further detect a humidity, and wherein the processor comprising hardware is configured to gradually decrease the charging bias from the first charging bias to the second charging bias at the first charging bias decreasing changing rate when the detector detects a first humidity and at the second charging bias decreasing changing rate when the detector detects a second humidity being lower than the first humidity.

12. The image forming apparatus according to claim 10, wherein the processor comprising hardware is configured to change the transfer bias from the second transfer bias to zero.

13. The image forming apparatus according to claim 10, wherein the transfer member includes an ion conductive roller.

14. An image forming apparatus comprising:

an image carrying member;

a charging member configured to charge a surface of the image carrying member;

a transfer member configured to transfer a developer image formed on the image carrying member to a sheet passing between the image carrying member and the transfer member;

a detector configured to detect a humidity; and a processor comprising hardware configured to:

change a transfer bias to be applied to the transfer member from a first transfer bias to a second transfer bias being smaller in absolute value than the first transfer bias and not zero in response to a sheet interval between the sheet and a next sheet;

(a) when the detector detects a first humidity, control a charging bias to be applied to the charging member in response to the sheet interval by:

gradually decreasing the charging bias from a first charging bias to a second charging bias being smaller in absolute value than the first charging bias at a first charging bias decreasing changing rate, the first charging bias decreasing changing rate being an amount of decrease in the charging bias per unit time, the first charging bias decreasing changing rate being constant and linear;

maintaining, for a fixed period of time, the charging bias at the second charging bias; and gradually increasing the charging bias from the second charging bias to the first charging bias at a first charging bias increasing changing rate, the first charging bias increasing changing rate being an amount of increase in the charging bias per unit time, the first charging bias increasing changing rate being constant and linear; and (b) when the detector detects a second humidity being lower than the first humidity, control the charging bias in response to the sheet interval by:

gradually decreasing the charging bias from the first charging bias to the second charging bias at a second charging bias decreasing changing rate, the second charging bias decreasing changing rate being an amount of decrease in the charging bias per unit time, the second charging bias decreasing changing rate being constant and linear, an absolute value of the second charging bias decreasing changing rate being less than an absolute value of the first charging bias decreasing changing rate;

maintaining, for the fixed period of time, the charging bias at the second charging bias; and gradually increasing the charging bias from the second charging bias to the first charging bias at a second charging bias increasing changing rate, the second charging bias increasing changing rate being an amount of increase in the charging bias per unit time, the second charging bias increasing changing rate being constant and linear, an absolute value of the second charging bias increasing changing rate being less than an absolute value of the first charging bias increasing changing rate.

15. The image forming apparatus according to claim 14, wherein the detector is configured to further detect a temperature, and wherein the processor comprising hardware is configured to gradually decrease the charging bias from the first charging bias to the second charging bias at the first charging bias decreasing changing rate when the detector detects a first temperature and at the second charging bias decreasing changing rate when the detector detects a second temperature being lower than the first temperature.

16. The image forming apparatus according to claim 14, wherein the processor comprising hardware is configured to change the transfer bias from the second transfer bias to zero.

17. The image forming apparatus according to claim 14, wherein the transfer member includes an ion conductive roller.

* * * * *